US008794206B2

(12) United States Patent
Methley et al.

(10) Patent No.: US 8,794,206 B2
(45) Date of Patent: Aug. 5, 2014

(54) ENGINE VALVE SYSTEM

(75) Inventors: Ian Methley, Witney (GB); Timothy Mark Lancefield, Shipston on Stour (GB)

(73) Assignee: Mechadyne International Limited, Kirtlington (GB)

( * ) Notice: Subject to any disclaimer, the term of this patent is extended or adjusted under 35 U.S.C. 154(b) by 71 days.

(21) Appl. No.: 13/391,436

(22) PCT Filed: Sep. 1, 2010

(86) PCT No.: PCT/IB2010/053927

§ 371 (c)(1),
(2), (4) Date: Feb. 21, 2012

(87) PCT Pub. No.: WO2011/027304

PCT Pub. Date: Mar. 10, 2011

(65) Prior Publication Data

US 2012/0160200 A1 Jun. 28, 2012

(30) Foreign Application Priority Data

Sep. 7, 2009 (GB) ..... 0915506.0

(51) Int. Cl.
*F01L 1/18* (2006.01)

(52) U.S. Cl.
USPC ..... 123/90.45

(58) Field of Classification Search
USPC ..... 123/90.15, 90.16, 90.39, 90.46; 74/559, 74/569
See application file for complete search history.

(56) References Cited

U.S. PATENT DOCUMENTS

| | | | | |
|---|---|---|---|---|
| 6,470,840 | B1 * | 10/2002 | Ebesu et al. | 123/90.17 |
| 6,854,434 | B2 | 2/2005 | Methley | |
| 6,941,910 | B2 * | 9/2005 | Methley | 123/90.16 |
| 8,534,245 | B2 * | 9/2013 | Methley et al. | 123/90.16 |
| 2002/0124783 | A1 * | 9/2002 | Dynes | 114/55.54 |
| 2004/0200446 | A1 | 10/2004 | Methley | |
| 2010/0132644 | A1 * | 6/2010 | Methley et al. | 123/90.44 |

FOREIGN PATENT DOCUMENTS

| | | | |
|---|---|---|---|
| GB | 2438628 | | 12/2007 |
| GB | 2456760 | | 7/2009 |
| KR | 783541 | B1 * | 12/2007 |
| WO | WO2008139221 | | 11/2008 |
| WO | WO 2009092995 | A1 * | 7/2009 |

* cited by examiner

*Primary Examiner* — Thomas Denion
*Assistant Examiner* — Steven D Shipe
(74) *Attorney, Agent, or Firm* — Shalom Wertsberger; Saltamar innovations

(57) ABSTRACT

An engine valve system comprises two cams (10,12) mounted coaxially, a summation rocker (14) coupled to followers (16,18) of both cams and movable in proportion to the instantaneous sum of the lifts of the respective cams, and a valve actuating rocker (20) pivotably coupled to the summation rocker (14) and operative to open an engine valve (22) in dependence upon the movement of the summation rocker (14). In the invention, the actuating rocker (20) rests on a hydraulic lash adjuster (24). A control spring (136) is provided to urge the summation rocker (14) in a direction to compress the hydraulic lash adjuster (24). A stop (138) associated with the control spring (136) limits the movement of the summation rocker (14) towards the lash adjuster (24) so as to set the clearance in the valve system when the valve (22) is closed and the cam followers (16,18) are on the base circles of the two cams (10,12).

16 Claims, 5 Drawing Sheets

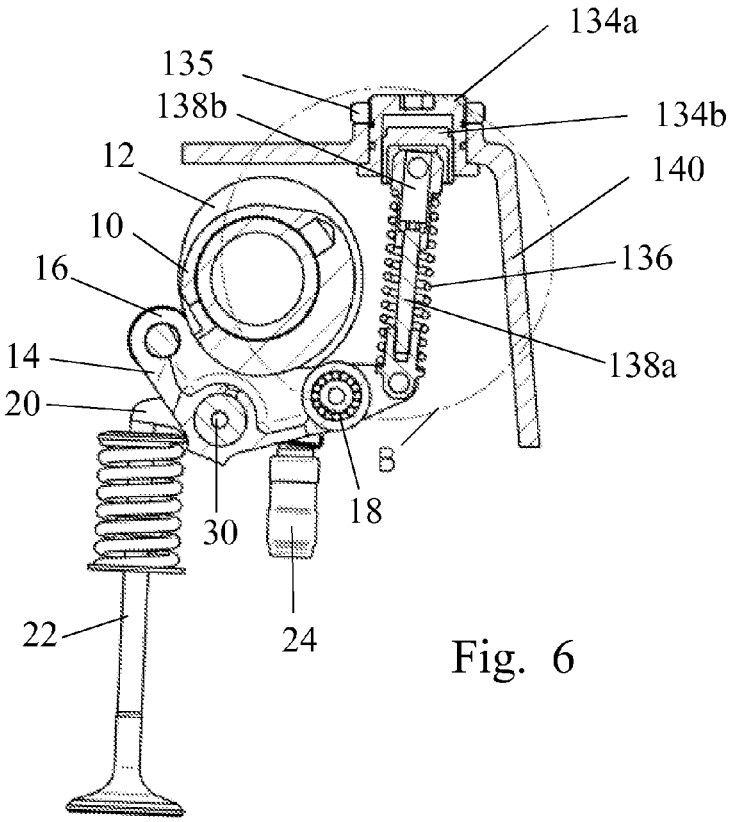
Fig. 6
SECTION A-A
Fig. 7
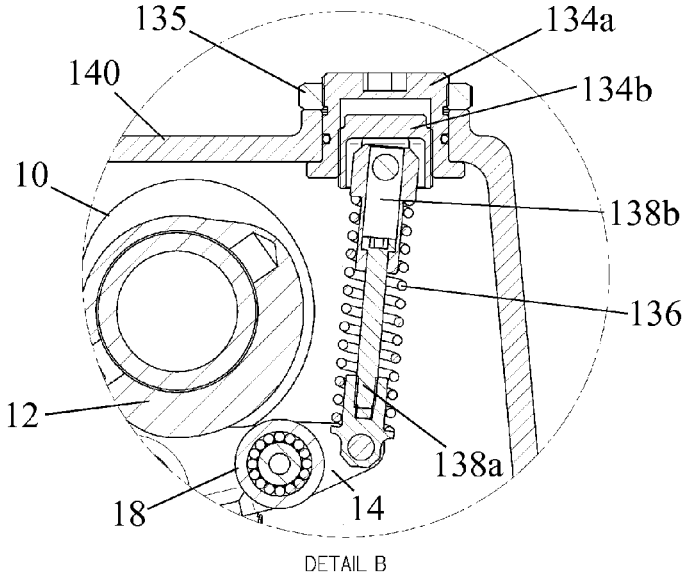
DETAIL B

SECTION A-A

SECTION B-B

SECTION C-C

ENGINE VALVE SYSTEM

FIELD OF THE INVENTION

The invention relates to an engine valve system that uses two cams to act on a valve by way of a summation mechanism to achieve variable valve event duration and lift.

BACKGROUND OF THE INVENTION

FIG. 1 of the accompanying drawings shows a cam summation engine valve system as disclosed in U.S. Pat. No. 6,941,910, upon which the present invention is based. The valve system comprises two cams 10 and 12 and a cam summation rocker 14, herein also termed an upper rocker, having cam followers 16 and 18 in contact with both cams. A lower actuating rocker 20 pivotably connected to the summation rocker 14 acts at one end on a valve 22 and rests at its other end on a hydraulic lash adjuster 24. An adjustable stop plate 26 is used to limit the expansion of the hydraulic lash adjuster 24 by setting the height of the pivot shaft 30 that connects the lower rocker 20 to the upper rocker 14. The position of the lower rocker 20 is therefore defined by its contact with the tip of the valve 22, and the expansion of the hydraulic lash adjuster 24 holding the pivot shaft 30 against the adjustable stop plate 26.

Cam summation valve systems using hydraulic lash adjusters have required an adjustable stop, or a graded shim in order for the system clearance (and hence the valve lift) to be adjusted. The functions of this clearance adjustment are twofold. First, the expansion of the hydraulic lash adjusters is limited so that the correct amount of clearance is maintained in the system whilst the valves are closed. Second, the valve actuating rocker is held in contact with the tip of the valve by the expansion of the hydraulic lash adjusters and the clearance adjustment system so that any clearance must occur between one of the cam profiles and its respective follower(s).

The Applicants have earlier proposed in WO2008/139221 a cam summation engine valve system as shown in FIG. 2 of the accompanying drawings. This figure shows a similar valve system to that shown in FIG. 1 and in it like parts have been allocated the same reference numerals to avoid repetition. Here, the valve actuating lower rocker 20 is mounted on a manually adjustable pivot 32. The valve lift is adjustable by means of a screw mechanism 34 and contact is maintained between the tip of the valve 22 and the lower rocker 20 at all times by means of a control spring 36.

This design does not benefit from an automatic lash adjuster, which is instead replaced by a mechanical clearance adjustment that maintains the correct amount of clearance in the system whilst the valves are closed. However, an adjustable pivot 32 is required to allow the amount of clearance in the system to be adjusted. In the absence of such adjustability, there would be no way to compensate for manufacturing tolerances, which may lead to significant variations in valve lift between cylinders, and potentially damaging impact forces between the components of the system. While it provides for clearance adjustment, the system of WO2008/139221 requires a significant amount of packaging space that may not be available in all engines. Furthermore the use of a hydraulic lash adjuster can compensate for the effects of thermal expansion and component wear throughout the life of the engine whilst a mechanical adjustment has to suit all operating conditions throughout the life of the engine.

OBJECT OF THE INVENTION

The present invention seeks to provide a valve system using two cams to act on a valve by way of a summation mechanism which retains the benefit of a hydraulic lash adjuster while still controlling the clearances when the cam followers are on the base circles of their associated cams and the valve is closed.

SUMMARY OF THE INVENTION

According to the present invention, there is provided an engine valve system comprising two cams mounted coaxially, a summation rocker coupled to followers of both cams and movable in proportion to the instantaneous sum of the lifts of the respective cams, and a valve actuating rocker pivotably coupled to the summation rocker and operative to open an engine valve in dependence upon the movement of the summation rocker, wherein the actuating rocker rests on a hydraulic lash adjuster, a control spring is provided to urge the summation rocker in a direction to compress the hydraulic lash adjuster, and a stop is associated with the control spring to limit the movement of the summation rocker towards the lash adjuster so as to set the clearance in the valve system when the valve is closed and the cam followers are on the base circles of the two cams.

The stop may take the form of telescopically collapsible strut of fixed maximum length connected at one end to the summation rocker and at the other end to a point that is stationary in relation to the engine block. Instead of a collapsible strut it is possible to employ a flexible cable or chain connected in the same manner.

The spring urging the summation rocker in a direction to compress the lash adjuster may suitably comprise a compression spring surrounding the strut or cable, but other forms of spring may be used. For example, the control spring may take the form of a torsion spring or an extension spring.

The stop is preferably adjustable so as to allow the clearance in the system to be adjusted.

If the stop is in the form of a strut or cable, its other end may be connected to an adjusting screw mounted in an engine cover. Alternatively, the strut may be of adjustable length and connected to a fixed mounting point.

BRIEF DESCRIPTION OF THE DRAWINGS

The invention will now be described further, by way of example, with reference to the accompanying drawings, in which:

FIG. 6 is a section in the plane designated A-A in FIG. 4, FIG. 7 is a detail of the section of FIG. 6 lying within the circle designated B shown to an enlarged scale.

DETAILED DESCRIPTION OF THE PREFERRED EMBODIMENT(S)

Figure 1:
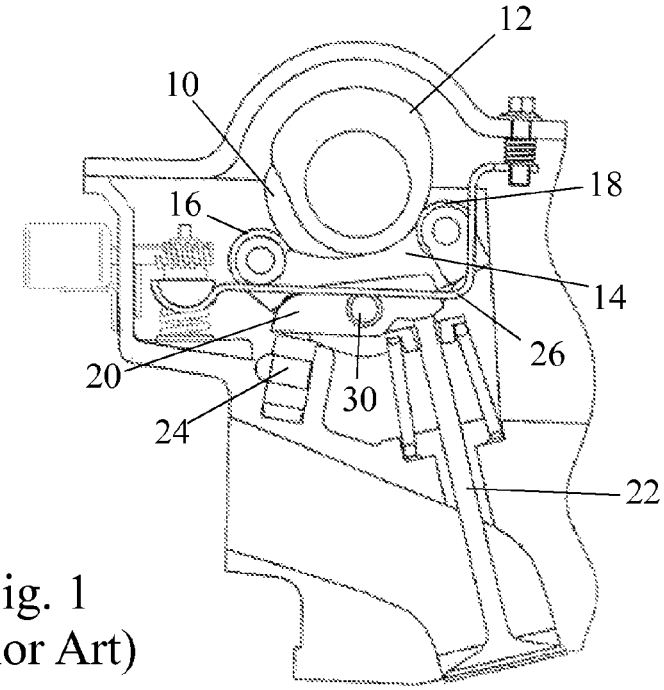
Fig. 1 (Prior Art)
FIG. 1 shows a valve system known from U.S. Pat. No. 6,941,910.
Figure 2:
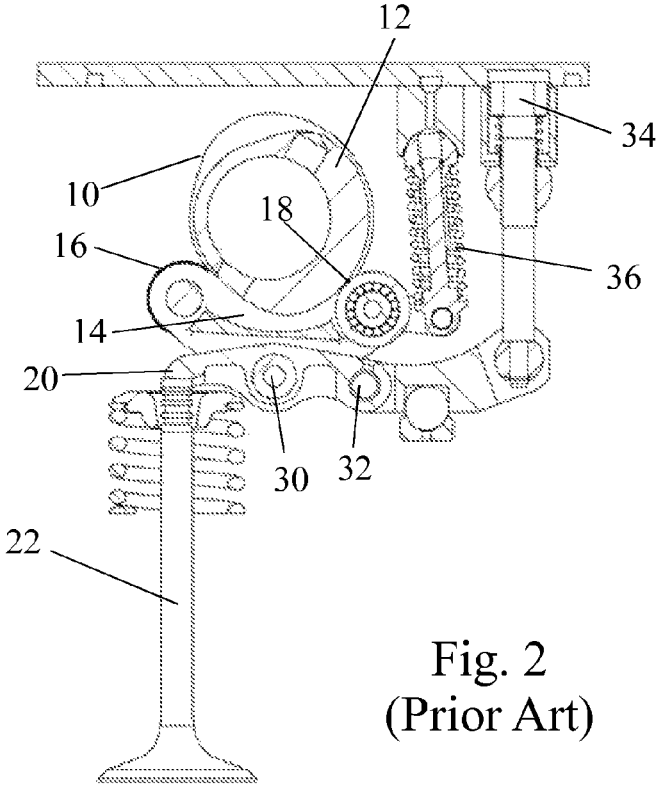
Fig. 2 (Prior Art)
FIG. 2 shown a valve system previously proposed by the present Applicants in WO2008/139221.
Figure 3:
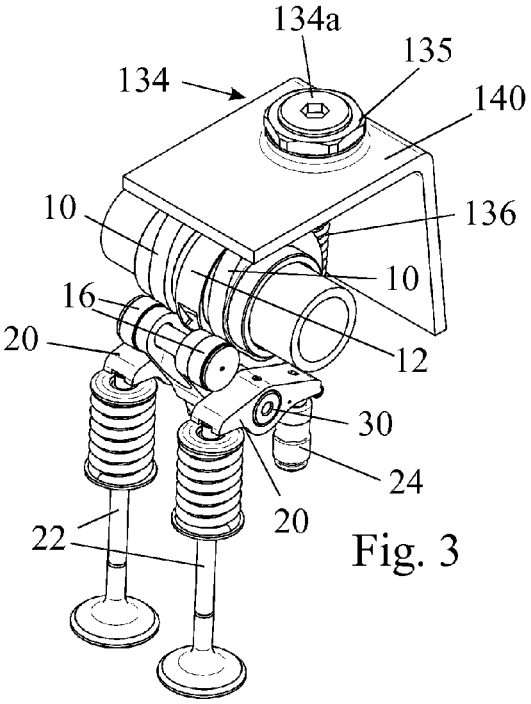
FIG. 3 is a perspective view of a valve system of the invention.

The components of the valve system of the invention that are similar to those already described with reference to FIGS. 1 and 2 have once again been allocated the same reference numerals and will not be described again in detail. To assist in identifying the changes introduced by the present invention, all components known from the prior art have been allocated reference numerals less than 100 and new components have reference numerals greater than 100.

Figure 4:
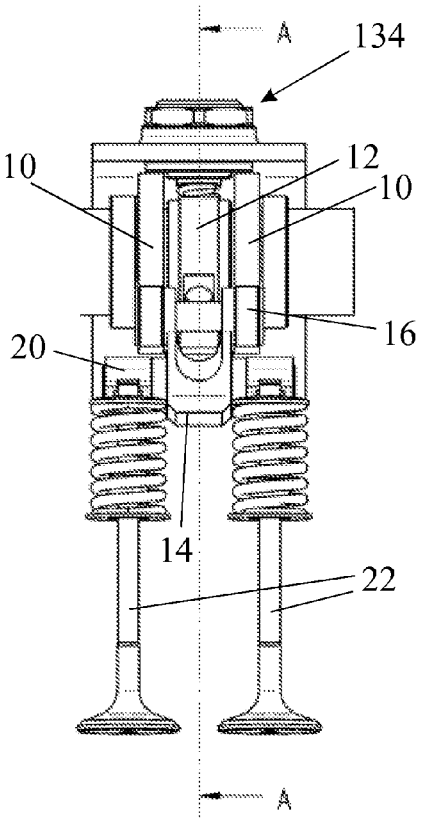
FIG. 4 is a side view of the valve system in FIG. 3.
Figure 5:
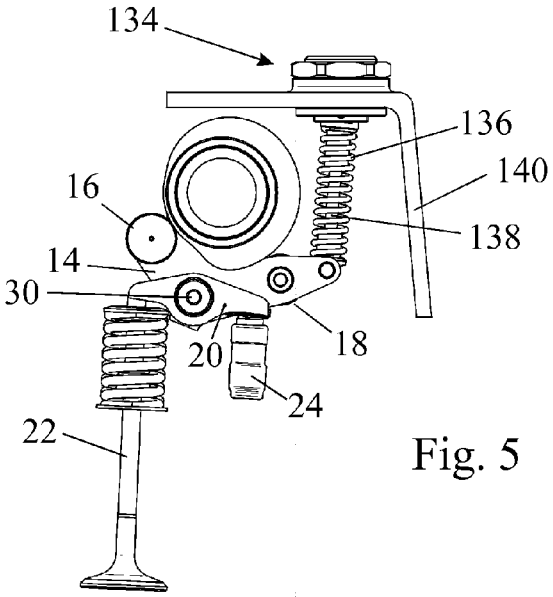
FIG. 5 is an end view of the valve system in FIGS. 3 and 4.
Figure 8:
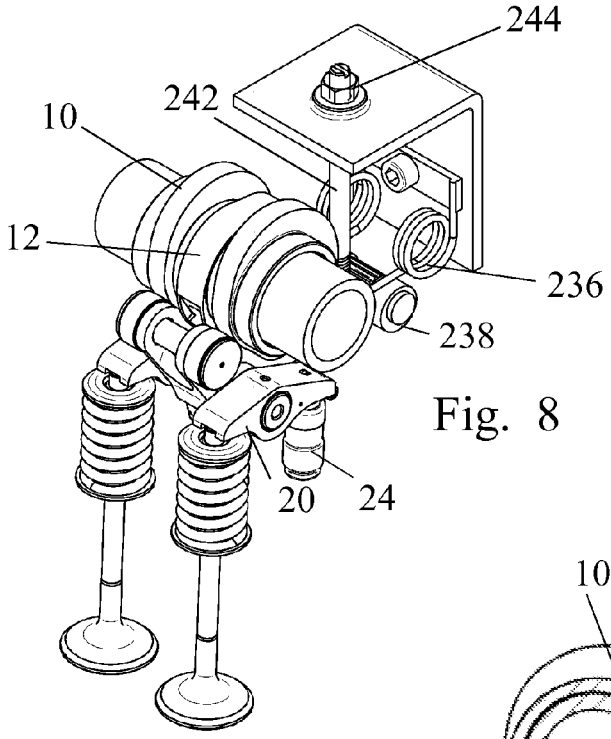
FIG. 8 is a perspective view similar to that of FIG. 3 showing a second embodiment of the invention.
Figure 9:
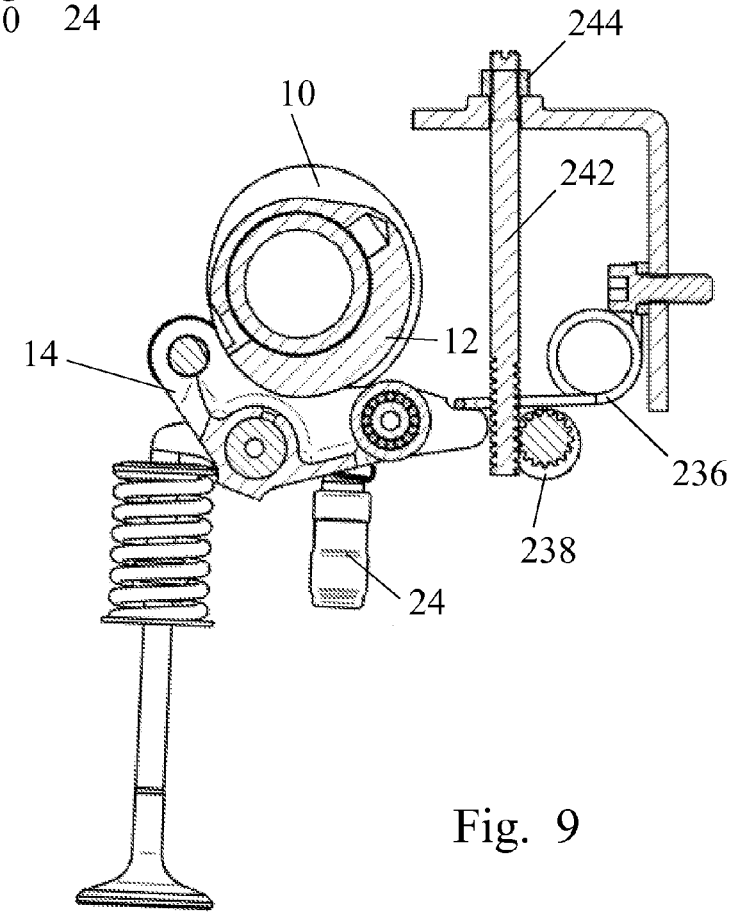
FIG. 9 is a section similar to that of FIG. 6 of the second embodiment of the invention.
Figure 10:
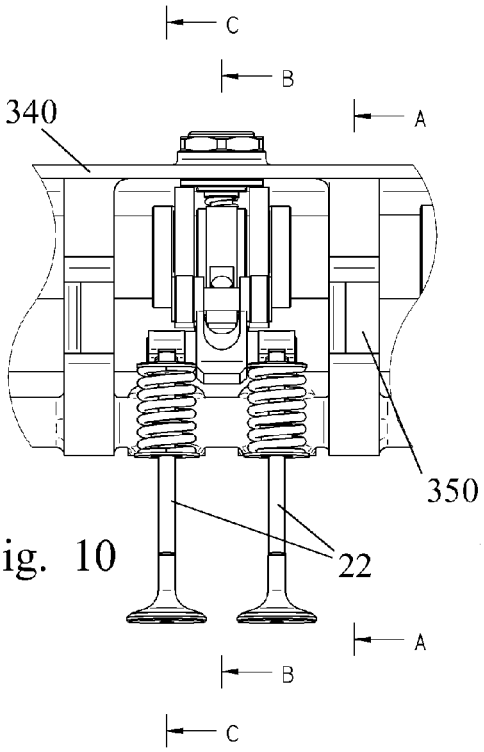
FIG. 10 is a side view similar to that of FIG. 4 showing a third embodiment of the invention.

The embodiment of FIGS. 3 to 7 has two poppet valves 22 that share a valve actuating system comprising two actuating rockers 20 mounted on a common pivot shaft 30 and lying on opposite sides of a common summation rocker 14. A pair of cams 10, straddles a single cam 12 and the common summation upper rocker 14 and followers 16 of like cams are connected to one another by an axle supported by the summation rocker 14 such that the followers 16, as best shown in FIG. 4, also straddle the summation rocker 14. This symmetry of the cams 10, the cam followers 16, and the actuating rockers 20 about the common summation rocker 14 ensures that the forces on the summation rocker 14 are always balanced avoiding any tendency for the summation rocker to twist out of alignment.

As the cams 10 and 12 rotate, the valve 22 is only opened when neither of the followers 16 and 18 is on the base circle of its associated cam 10 or 12. When both sets of followers are on their cam lobes, the valve is opened, the valve opening being determined by the sum of the instantaneous lifts of the two cams. The cams 10 and 12 can be separately phased relative to one another and relative to the engine crankshaft to allow the duration, lift and phase of the valve event to be varied to suit the prevailing engine operating conditions.

The invention is concerned with the setting of the clearance in the valve system when both cam followers 16 and 18 are on the base circles of their respective cams and the valves 22 are closed. The action of the hydraulic lash adjusters 24 supporting the two actuating rockers 20 is to tend to remove this clearance completely and to push both sets of cam followers 16, 18 into contact with their respective cams 10,12.

To prevent this from taking place, the illustrated embodiment of the invention comprises a telescopically collapsible strut 138 surrounded by a control spring 136. The strut 138 is made up of two parts 138*a* and 138*b* that can slide relative to one another to reduce the length of the strut 138 but its length cannot be increased further once it reaches the end position shown in FIG. 7. The part 138*a* is pivotably connected to the summation rocker 14 while, at the opposite end of the strut 138, the part 138*b* is connected to a mounting point on a cover 140 of the engine cylinder head.

The mounting point, which is generally designated 134, comprises a hollow cap 134*a* with a threaded bore that receives an externally threaded piston 134*b* pivotably connected to the end of the upper part 138*b* of the strut 138. The cap 134*a* has an external shoulder which abuts the underside of the cylinder head cover such that rotation of the cap 134*a* causes the height of the piston 134*b* to move within the bore of the cap, positioning the end of the strut 138 relative to the cylinder head cover 140. The cap 134*a* is slidingly received into the cylinder head cover 140 and its rotational position is secured by a lock nut 135.

The strut 138 is shown in FIG. 7 in its position when the cam followers 16 and 18 are both on the base circles of their associated cams 10, 12. The control spring 136 pivots the summation rocker 14 clockwise about the pivot shaft 30 so that the followers 16 contact their cams 10 while the follower 18 is spaced from its cam lobe 12 by the desired clearance dictated by the strut 138. By adjusting the position of the mounting 134, i.e. by repositioning the piston 134*b* within the cap 134*a*, the position of the stop formed by the strut 138 can be varied to set the system clearance as desired.

When the hydraulic lash adjuster 24 attempts to expand with the strut 138 in this position, it cannot apply sufficient force to compress the control spring 136 and this limits the expansion of the lash adjusters 24. When both of the followers 16, 18 comes off the base circle of their cams and move on to the cam lobe, the summation rocker 14 pivots about the pivot 30 to bring both the followers 16, 18 into contact with their respective cams 10, 12 and thereafter the spring 136 is compressed as the valves 22 are opened. Though the control spring 136 cannot be compressed by the force applied by the lash adjusters 24, it cannot resist the force of the valve springs which apply a reaction force to the summation rocker 14 through the two actuating rockers 20 and the pivot shaft 30.

It will be clear from the above description that the purpose of the strut 138 is to limit the extent that the control spring 136 can expand when the valves are closed, without interfering with compression of the control spring 136 when the valves are being opened. The strut 138 needs to be collapsible in length but incapable of being extended beyond a set limit. The same function would be served if a chain or a cable replaced the strut 138.

Setting of the desired system clearance need not be carried out by moving the mounting point 134. It would be alternatively possible to reduce or increase the maximum length of the strut 138 while acting against a fixed mounting point.

In the second embodiment of the invention the compression spring 136 and strut 138 are replaced by a torque spring 236 having a means to limit its travel. The clearance is controlled by adjusting the expansion stop for the torque spring. The stop itself is illustrated as being a cam 238 that acts upon the torque spring 236 and is held in position via an adjusting screw 242 threaded into the cylinder head cover 240 and a locking nut 244. The stop could alternatively be designed to contact the summation rocker 14 instead of the torque spring 236.

The two embodiments described above offer the opportunity for the system clearance to be adjusted whilst the engine is fully assembled because the adjusting system may be accessed from the outside of the camshaft cover, but the third embodiment shown in FIGS. 10 to 13 offers the advantage of allowing the system adjustment to be carried out before it is assembled to the cylinder head.

In the third illustrated embodiment, a carrier 350 is provided to which the cams 10, 12 and rocker system 14, 20 are fitted. The assembled carrier 350 is then fitted to the cylinder head as a single unit. The adjustment of the clearance is carried out before the carrier assembly is fitted to the cylinder head because it already contains all of the components that dictate the system clearance—namely the cams 10 and 12, the summation rocker 14, the return spring strut 336, 338 (same as in the first embodiment) and its mounting to the cylinder head cover 340. All other component tolerances associated with the valves and the cylinder head will be compensated for by the hydraulic lash adjuster 24 and will not affect the running clearance of the system.

Figure 11:
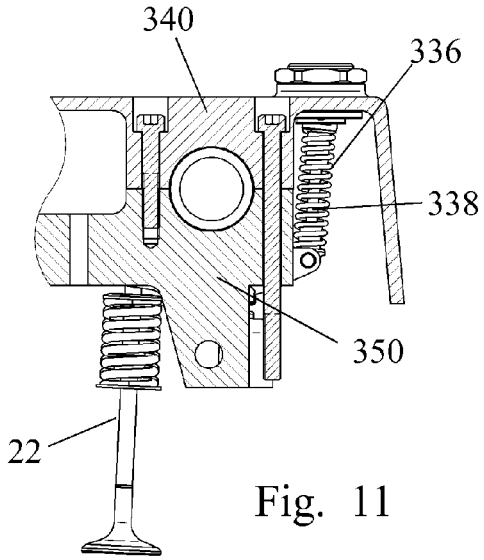
FIGS. 11 to 13 are sections through the third embodiment of the invention, taken in the planes designated A-A, B-B and C-C, respectively, in FIG. 10.
Figure 12:
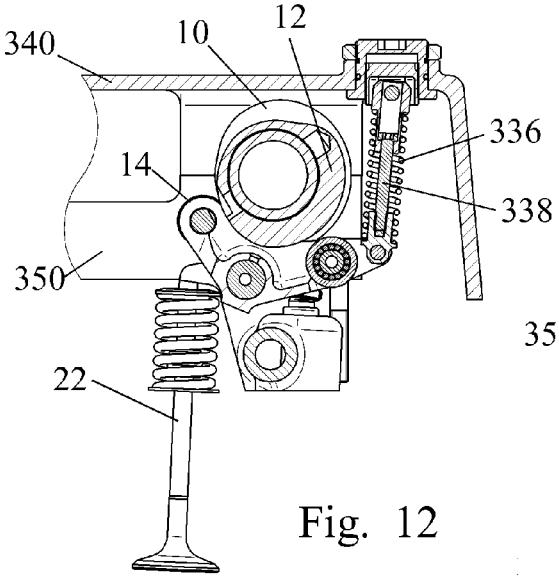
Figure 13:
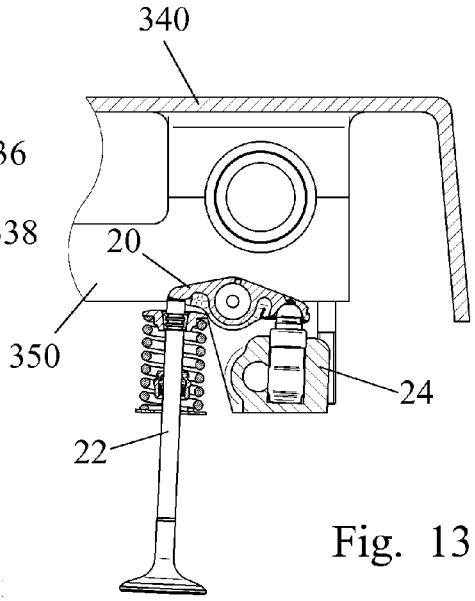

FIG. 11 shows how the top half of the camshaft bearings are formed by the cylinder head cover 340 and the lower half forms part of a camshaft carrier 350. The carrier 350 also contains the hydraulic lash adjusters 24 and their associated oil supply system. The rocker system is located by the hydraulic lash adjusters 24 and the return spring 336 and its strut 338 whilst the cam carrier 350 and cover 340 assembly is fitted to the engine such that the valve actuating rockers will locate correctly onto the corresponding valve tips.

As well as incorporating the lash adjusters 24, the camshaft carrier 350 contains oil passages for lubricating the camshaft bearings and for controlling the relative phase of the cams.

The invention thus allows the benefits of a hydraulic lash adjustment to be retained while enabling the valve train system to be supplied as a unit with its operating clearance already set.

The invention claimed is:

1. An engine valve system comprising:

two cams mounted coaxially, a summation rocker coupled to followers of both cams and movable in proportion to the instantaneous sum of the lifts of the respective cams;

a valve actuating rocker pivotably coupled to the summation rocker and operative to open an engine valve in dependence upon movement of the summation rocker, wherein the actuating rocker rests on a hydraulic lash adjuster;

a control spring to urge the summation rocker in a direction to compress the hydraulic lash adjuster; and, a stop comprising an element of fixed maximum length acting upon the control spring to limit the movement of the summation rocker towards the lash adjuster so as to set a clearance in the valve system when the valve is closed and the cam followers are on base circles of the two cams;

wherein the element of fixed maximum length is selected from a group comprising a telescopically collapsible strut, a cable and a chain, and wherein the element is coupled at a first end to the summation rocker and at a second end to a mounting point coupled to the engine block.

2. An engine valve system as claimed in claim 1, wherein the mounting point is fixed in relation to the engine block.

3. An engine valve system as claimed in claim 2, wherein the control spring urging the summation rocker in a direction to compress the lash adjuster comprises a compression spring surrounding the element of fixed maximum length.

4. An engine valve system as claimed in claim 3, wherein the position of the stop is adjustable so as to allow the clearance in the system to be adjusted.

5. An engine valve system as claimed in claim 1, wherein the stop has a position that is adjustable so as to allow the clearance in the system to be adjusted.

6. An engine valve system as claimed in claim 1, wherein the mounting point is adjustable in relation to the engine block.

7. An engine valve system as claimed in claim 1, wherein the maximum length of the element of fixed maximum length is adjustable.

8. An engine valve system as claimed in claim 1, wherein the control spring is a torque spring and the stop acts to limit an angle to which the torque spring can unwind.

9. An engine valve system as claimed in claim 8, wherein the stop, the mounting point, or a combination thereof is adjustable.

10. An engine valve system as claimed in claim 8, wherein the position of the stop is adjustable so as to allow the clearance in the system to be adjusted.

11. An engine valve system as claimed in claim 1, wherein the clearance in the engine valve system is adjustable whilst the engine valve system is fully assembled.

12. An engine valve system as claimed in claim 1, wherein the summation rocker, the valve actuating rocker and the camshaft are assembled into a camshaft carrier fitted to the engine as a pre-assembled unit.

13. An engine valve system as claimed in claim 12, wherein the camshaft carrier assembly incorporates the hydraulic lash adjuster and oil supply passages associated with the lash adjuster.

14. An engine valve system as claimed in claim 13, wherein the camshaft carrier contains oil passages for lubricating bearings supporting the camshaft and for supplying oil to a cam phasing mechanism serving to rotate the cams relative to one another.

15. An engine valve system as claimed in claim 12, wherein the camshaft carrier contains oil passages for lubricating bearings supporting the camshaft and for supplying oil to a cam phasing mechanism serving to rotate the cams relative to one another.

16. An engine valve system as claimed in claim 1, wherein the control spring urging the summation rocker in a direction to compress the lash adjuster comprises a compression spring surrounding the element of fixed maximum length.

* * * * *